US006227743B1

(12) United States Patent
Robb

(10) Patent No.: US 6,227,743 B1
(45) Date of Patent: May 8, 2001

(54) PEN CAP STYLUS FOR USE WITH TOUCH SCREENS

(76) Inventor: Karl A. Robb, 4182 Lord Culpepper Dr., Fairfax, VA (US) 22030

( * ) Notice: Subject to any disclaimer, the term of this patent is extended or adjusted under 35 U.S.C. 154(b) by 0 days.

(21) Appl. No.: 09/346,414

(22) Filed: Jul. 1, 1999

(51) Int. Cl.[7] ..... B43K 23/12

(52) U.S. Cl. ..... 401/243; 401/258; 401/195

(58) Field of Search ..... 401/88, 98, 6, 401/243, 245, 246, 247, 195, 52, 258

(56) References Cited

U.S. PATENT DOCUMENTS

| | | | | |
|---|---|---|---|---|
| D. 318,293 | * | 7/1991 | Flowers | 401/88 |
| D. 330,388 | * | 10/1992 | Choi | 401/195 |
| D. 354,689 | | 1/1995 | Figard | D19/36 |
| D. 355,440 | | 2/1995 | Lin | D19/51 |
| D. 364,892 | | 12/1995 | Lin | D19/49 |
| D. 390,872 | | 2/1998 | Sunaga | D19/36 |
| D. 402,690 | | 12/1998 | Hazzard | D19/51 |
| 2,312,069 | * | 2/1943 | Baumgartner | 401/98 |
| 2,699,147 | * | 1/1955 | Rhoades | 401/195 |
| 2,799,506 | | 7/1957 | Nord | 273/144 |
| 3,961,852 | | 6/1976 | Parry | 401/195 |
| 3,963,914 | | 6/1976 | Browning et al. | 240/6.46 |
| 4,302,121 | * | 11/1981 | Kim | 401/98 |
| 4,595,307 | * | 6/1986 | Heyden | 401/88 |
| 4,763,355 | | 8/1988 | Cox | 379/355 |
| 4,778,302 | | 10/1988 | Martinez | 401/195 |
| 4,801,145 | | 1/1989 | Arevalo | 273/143 R |
| 5,016,881 | | 5/1991 | Lindsey | 273/138 A |
| 5,086,577 | | 2/1992 | Abernethy | 40/334 |
| 5,555,602 | * | 9/1996 | Leamond | 401/88 |
| 5,913,629 | * | 6/1999 | Hazzard | 401/33 |
| 6,019,536 | * | 2/2000 | Lee | 401/88 |

* cited by examiner

*Primary Examiner*—David J. Walczak
(74) *Attorney, Agent, or Firm*—Roberts Abokhair & Mardula, LLC

(57) ABSTRACT

A pen cap stylus (or screen operator) is useful in combination with a conventional writing implement, such as a pencil or an ink pen. The manner in which the pen cap stylus screen operator engages to an end of a writing implement is analogous to how a pen cap engages either end of the pen for which it was designed. To form a hybrid instrument for use both as a computer stylus and as a writing instrument, the pen cap stylus is placed on the end of the writing instrument opposite the writing element. The pen cap stylus has a pointy tip for engaging a touch screen of a computer device to selectively actuate microswitches therein. The writing element disposed at the other end of the writing instrument maintains its conventional utility.

14 Claims, 3 Drawing Sheets

PEN CAP STYLUS FOR USE WITH TOUCH SCREENS

BACKGROUND OF THE INVENTION

1. Field of the Invention

The present invention relates to devices for operating touch screens. More specifically, the present invention relates to a device for modifying a writing instrument so as to be useable as a device for operating controls on a screen of an automated data device.

2. Background Art

Personal data devices for storing and handling information have come into widespread use in recent years. Some devices have been developed that are intended to assist individuals as automated secretaries (also known as "personal digital assistants" or PDAs). An example is a device known as an electronic notebook. An electronic notebook is a data processing device that has a microprocessor and a display screen, and is adapted to store information and to categorize or otherwise handle the information. Personal data devices may be programmed to enable a user to enter data and control commands that determine how the data is entered, stored, and manipulated. Examples of personal data devices include the Palm series, marketed by 3Com Corp. of Santa Clara, Calif. Apple Computers additionally markets the Newton MessagePad. Other similar products are available on the market. Applications for these devices are growing on a daily basis.

Typically, such devices receive control commands via very small electrical switches, called microswitches, which are integrated into the display screen. A user inputs commands and information into the device by touching a portion of the display screen where a microswitch is located. A display portion of the display screen portrays images corresponding to screen positions that are associated with available input selections (commands or information). The display portion may also show a screen position being contacted, as a visual feedback to the user that an entry has been made.

As personal data devices may be quite small and compact, it follows that the screens are also small. Accordingly, each of the microswitches on the screen is quite small and they may be crowded quite closely together. Successfully entering a command is dependent upon having a suitable utensil for contacting the screen in a limited area in a manner that will operate a selected microswitch, but will not operate other, adjacent microswitches inadvertently. Typically, the personal data device is provided with an elongated stylus that is held in the user's hand and that may be placed in contact with the screen at a selected position to operate a microswitch to carry out a particular command or to enter data.

The conventional styli that are provide with personal data devices suffer from the problem of being easily lost. Although it is common for a personal data device to have a receptacle therein for storing its stylus, many users do not consistently replace the stylus in its storage receptacle when the device is not in use. The stylus is often perceived as a mere piece of plastic, and thus, is not carefully handled.

However, despite being inexpensive, the stylus is essential to the operation of the personal data device, so when the stylus is lost, a substitute must be found promptly. Waiting for the personal data device manufacturer to ship a new stylus is a substantial inconvenience. Besides, paying shipping charges for an inexpensive stylus is not economically efficient.

But there is no other suitable choice. Because the stylus is approximately the size and shape of a writing instrument, one may be tempted to replace a missing stylus with a writing instrument. This is not suitable because the working point of a writing instrument will damage the display screen of the device. Furthermore, the cap and butt end of the writing instrument are not precisely shaped so as to be effective as a stylus substitute. Since those portions of the writing instrument are not precisely shaped so as to activate only one microswitch at a time, they serve mainly to frustrate the user rather than provide for reliable input to the personal data device.

Another problem in the prior art is the inconvenience of switching back and forth between a writing instrument for working with paper-based media and a stylus for working with electronic media (i.e., a personal data device). The advent of personal data devices has the unfortunate side-effect of doubling the number of input tools that need to be kept track of: a pen and a stylus. Although hybrid devices for use with both types of media have been proposed, these proposals are all unsatisfactory because they do not solve the problem of how to retro-fit old writing instruments to be dual purpose.

Design Pat. No. Des. 390,872 shows an ornamental design for a combined computer input pen and writing instrument. It is a special purpose writing instrument that is formed with a writing tip fixed at one end and a computer input tip fixed at the opposite end.

Design Pat. Nos. Des. 355,440 and Des. 364,892 each show an ornamental design for a pen. In each case, the closed end of the cap has a rounded end that does not appear to be sufficiently pointy for effective use as a stylus for actuating microswitches of a touch screen.

Design Pat. No. Des. 402,690 shows an ornamental design for a stylus tip pen. It is a special purpose writing instrument that is formed with a computer input tip fixed at one end thereof, and having a retractable writing tip disposed at that same end. The pen has no cap.

Utility U.S. Pat. No. 4,778,302 shows a combination writing instrument and handcuff locking and unlocking device. It is a special purpose writing instrument that is formed with two retractable tips, which are alternately extendable from the same end of the writing instrument. One retractable tip is a writing element and the other retractable tip is a handcuff-locking element. It appears that the handcuff-locking element is not sufficiently pointy to be used as a stylus for a personal data device. The writing instrument has no cap.

Thus, what is needed is a convenient substitute for the stylus of a personal data device. What is also needed is a convenient way to modify conventional writing instruments to form a hybrid instrument that can be used as a stylus for a personal data device and as a writing instrument.

SUMMARY OF THE INVENTION

The present invention is directed to a screen operator that is suitable for operating microswitches that are formed in touch screens of personal data devices. The screen operator envelops and is retained by either end of a writing instrument. With the screen operator in place on an end of a writing instrument, the combination of the screen operator and the writing instrument is useable as a replacement for the stylus of a personal data device. The combination of the screen operator and the pen cap of a writing instrument also has dual usefulness both as a stylus and as a writing instrument—the combination does not rob the writing instrument of its original utility and serves to add a new one.

It is an object of the present invention to provide an article that is a convenient substitute for the stylus of a personal data device.

It is another object of the present invention to provide an article that is a hybrid instrument that is useable as a stylus for a personal data device, a pen cap, and as a writing instrument.

In order to achieve the above objects, the present invention provides a screen operator for use with a touch screen having microswitches. The screen operator includes an elongated barrel that is open at a first end thereof, and an operating tip connected to a second end of the elongated barrel.

In order to achieve the above objects, the present invention also provides a cap for use with a writing instrument to operate a touch screen having microswitches. The cap includes an elongated barrel that is open at a first end thereof, and an operating tip connected to a second end of the elongated barrel.

In order to achieve the above objects, the present invention also provides, as a combination, a screen operator and a writing instrument. The screen operator includes an elongated barrel having an open first end thereof, and an operating tip connected to a second end of the elongated barrel. The writing instrument is engaged with the screen operator by being partially inserted into the open first end of the elongated barrel.

BRIEF DESCRIPTION OF THE DRAWING

Various other objects, features, and attendant advantages of the present invention will become more fully appreciated as the same becomes better understood when considered in conjunction with the accompanying drawing figures, in which like reference characters designate the same or similar parts in all the views.

DETAILED DESCRIPTION OF THE INVENTION

Figure 1:
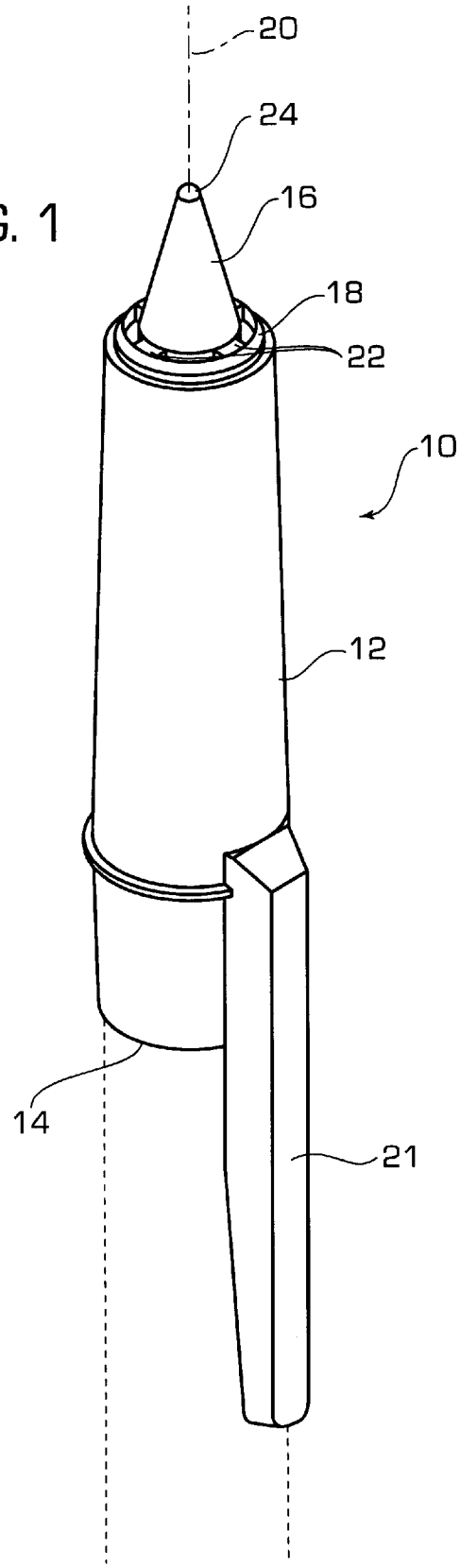
FIG. 1 illustrates a perspective view of a preferred embodiment of the present invention.

As utilized in this description, personal data devices include small electronic devices utilized as a portable personal computer capable of storing and retrieving information such as calendars, phone books, and the like. Examples include devices such as the Palm Pilot, distributed by 3Com Corp. of Santa Clara, Calif. These devices include a screen to manipulate its functions. Various sections of the display screen are touched by a screen operator to manipulate the functions of the instrument. A screen operator is usually an instrument in the shape of a pen or a pencil, having a point of small enough size to allow the user to select the various functions of the personal data device.

A screen operator according to the present invention is useful in combination with a conventional writing implement, such as a pencil or an ink pen. The manner in which the screen operator engages to an end of a writing implement is analogous to how a pen cap engages either end of the pen for which it was designed. Even though a given pencil or a pen may not have been intended by its original manufacturer to have a cap, there is no inherent, general reason that all elongate writing implements cannot have a cap-like structure placed on either end. The present invention takes advantage of this fact.

The closed ends of prior art pen caps have not been specially configured to have dimensions useful for actuating microswitches in touch screens of computer devices. By modifying the pen cap of the prior art to be combined with the tip of a stylus of a personal data device, the present inventor has discovered a hybrid instrument. The hybrid instrument is embodied as the modification of a conventional writing implement by substituting a cap-like screen operator in place of its conventional cap, or in the case of writing implements that do not have caps (pencils, retractable pens, etc.), adding a cap to the writing implement. The cap of the present invention can be utilized alone. Due to the affordability of such an instrument, the instrument of the present invention can be purchased as a replacement to the screen operator devices for the personal data devices. The instrument of the present invention can also be utilized with any object that looks like a pen or a pencil. This would allow some people to achieve better control of a larger object as compared to the cap alone.

In each case, the cap like screen operator is to be engaged at the end of the writing implement usually opposite the end where the writing element is disposed, at least when being actively used. For storage, the cap-like screen operator may be engaged over the end where the writing element is disposed, for the purpose of protecting the writing element. In this respect, the screen operator is intended to perform the function of protecting the writing element essentially the same as a conventional cap. In the storage configuration however, the screen operator maintains the functionality of being useable as a stylus.

FIG. 1 shows a screen operator 10, which has a body 12 dimensioned and configured at a first end 14 to engage the exterior of a writing instrument (shown in phantom). Typically, the body 12 is configured as a cylindrical barrel that is open at the first end 14. The screen operator 10 also has a tip member 16, which is disposed at a second end 18 of the body 12. The body 12 engages the exterior of the writing instrument by full encirelement at either end thereof. Preferably, the body 12 is generally tubular. The body 12 has a central longitudinal axis 20. The axis 20 need not necessarily be coaxial with the writing instrument, however, this characteristic is helpful in maintaining accuracy of screen operator 10 when in use.

A pocket clip structure 21 is disposed at the first end 14 of the body 12, extending longitudinally from the periphery of the body 12. When the screen operator 10 is engaged with an end of a writing instrument, the pocket clip 21 is useful for clipping the combined assembly to the upper edge of a shirt pocket.

The tip member 16 projects outwardly from the second end 18 of the body 12 along the longitudinal axis 20. The tip member 16 is connected to the body 12 via connecting members 22. The connecting members 22 are radially disposed between the body 12 and the tip member 16. The tip member 16 is preferably arranged so as to be coaxial with the central longitudinal axis 20 of the body 12.

The tip member 16 is preferably frustoconical in shape. Although the size of the extreme end of the tip member 16 can vary substantially, it is important that it be neither too big nor too small. The end of the tip member should be sufficiently small to reliably actuate the microswitches via contact with the touch screen. Conversely, the end of the tip member should be sufficiently large to reliably prevent such contact from damaging the touch screen. That is to say, if the point is too sharp it will puncture or score the touch screen. The end dimension of the tip member 16 (at its extreme tip 24) is preferably round and without sharp edges. The width dimension of the tip is dictated by the size of the control functions on the screen of the personal data device. Most devices can be controlled with a tip in the 2 to 3 millimeters range. The tip of the device of the present invention can be much smaller, in the range of 0.5 mm. However, the device should not be too small, to where sharp edges are created that might damage the screen on the personal data device.

According to one embodiment of the present invention, the narrowest extremity of the operating tip preferably has a width in the range of about 0.5 mm to about 3 mm, and most preferably about 1 mm or 2 mm. A rounded tip for this embodiment has a radius of curvature that is preferably in the range of about 0.5 mm to about 1.0 mm, and most preferably 0.3 mm. According to an alternate embodiment, the narrowest extremity of the operating tip preferably has a width in the range of about 0.1 mm to about 1 mm, and most preferably about 1.0 mm.

Figure 2:
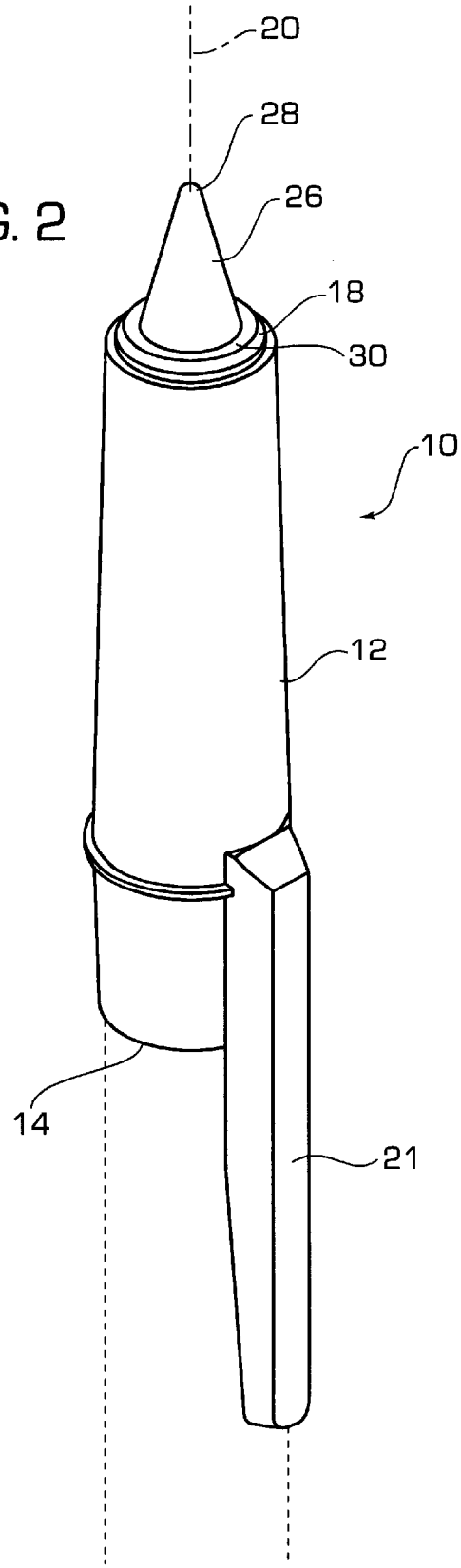
FIG. 2 illustrates a perspective view that portrays aspects of alternate embodiments of the present invention.

Aspects of the invention according to alternate embodiments are shown in FIG. 2. According to one alternate embodiment, the tip member 26 is shaped as a modified cone wherein the salient modification is that its extreme tip 28 is rounded. The radius of curvature of the rounded tip 28 is preferably sufficient to provide a tip size as described above. The length of the tip is preferably about 5 millimeters. The length of the tip can range from 2 to 10 millimeters. The idea is to provide an aesthetically appealing tip on a "pen cap". Accordingly, the tip should not provide a shape that is much different than pen cap. This should not be considered a limitation of the present invention, but merely an aesthetic preference.

FIG. 2 also shows another alternate aspect of the invention wherein the tip member 26 is connected to the body 12 via a single connecting member 30.

According to another alternate aspect of the invention, a broad, widened tip (not shown) is employed.

Although the pocket clip structure 21 is certainly a useful part of the invention, it is not essential to the successful operation of the invention. Accordingly, the invention may be embodied such that the pocket clip structure 21 is omitted.

The screen operator 10 is fabricated from a material or materials providing substantial rigidity. That is, the body 12 is sufficiently rigid to maintain its configuration after it is engaged on the writing instrument and pressure is applied to the tip member 16. Any suitable material, or combination of materials, exhibiting the above characteristics will be adequate. Preferably, but not necessarily, the screen operator is formed so as to be unitary.

One suitable construction is to form the entire screen operator 10 of a substantially homogeneous polymer, via well-known molding techniques. Another suitable construction is a relatively rigid yet bendable metal frame (not shown) surrounded by flexible polymer material (not shown). This alternate construction provides the body 12 with the property of being somewhat flexible and resilient at its interior surface for providing secure engagement with a writing instrument that has a cross-section that is not strictly round. Examples of foreseeable cross-sections that are accommodated by this construction are hexagonal and irregular (e.g., because of an integral pocket clip on the body of the writing instrument).

Figure 3:
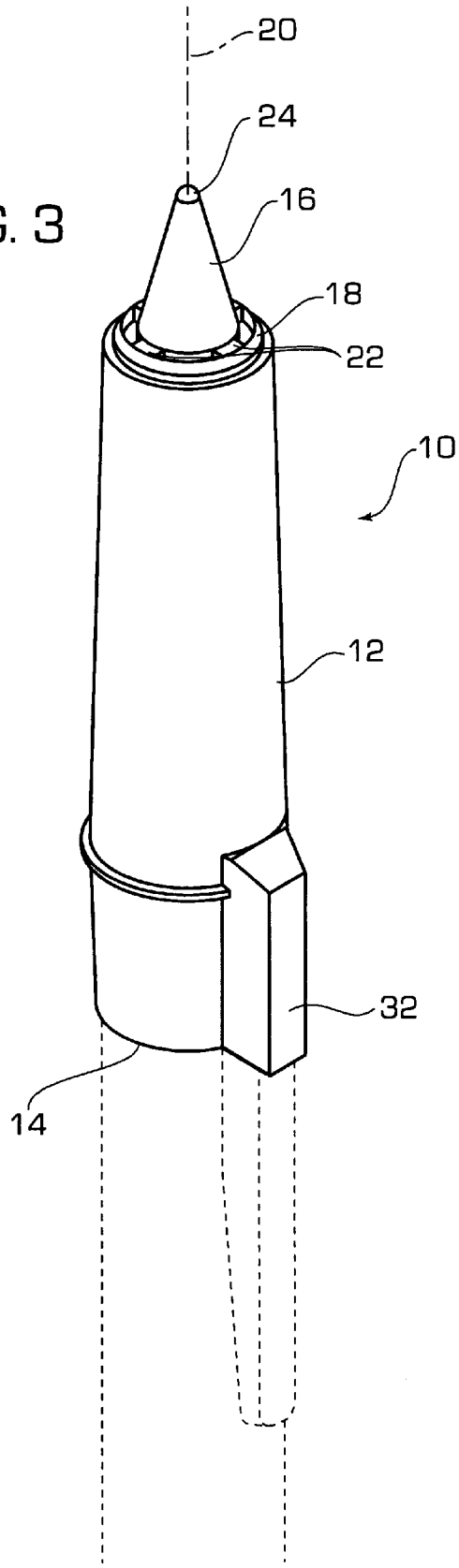
FIG. 3 illustrates a perspective view according to an alternate embodiment of the present invention.

A writing implement that has an integral pocket clip presents a special case. One way of providing for secure engagement of the screen operator to the body of such a writing implement is the construction method discussed above. Alternately, the irregular body cross-section of a writing implement having a pocket clip is well accommodated by forming the body 12 of the screen operator 10 in a conforming configuration as shown in FIG. 3. The body 12 of the screen operator 10 is formed so as to have a bulge 32. The bulge 32 provides for an internal surface contour (not shown) that substantially matches the exterior surface shape of the body of the writing implement (shown in phantom), including any irregularities due to an integral pocket clip (shown in phantom).

The invention has been described in terms of preferred embodiments. However, it will be appreciated that various changes and modifications may be made to the preferred embodiments without departing from the scope of the invention as described. The invention is limited only by the appended claims.

What is claimed is:

1. A cap for use with a writing instrument to operate a touch screen having microswitches, the cap comprising:

an elongated barrel that is open at a first end thereof, and an operating tip connected to a second end of said elongated barrel;

wherein said operating tip is dimensioned so as to be sufficiently small to reliably actuate the microswitches via contact with the touch screen and so as to be sufficiently large to reliably prevent such contact from damaging the touch screen; and wherein said operating tip has a shape selected from the group consisting of: frustoconical, and generally conical with a rounded tip.

2. The cap of claim 1, wherein said operating tip has a frustoconical shape, said operating tip having a narrowest extremity that has a width in the range of about 0.5 mm to about 3 mm.

3. The cap of claim 2, wherein said narrowest extremity of said operating tip has a width of about 1.0 mm.

4. The cap of claim 1, wherein said operating tip has a generally conical shape with a rounded tip, said rounded tip have a radius of curvature in the range of about 0.5 mm to about 1.0 mm.

5. The cap of claim 1, further comprising: a pocket clip attached to said elongated barrel at a peripheral portion of said first end.

6. The cap of claim 1, wherein said elongated barrel is substantially cylindrical and is sized to engage an end of the writing instrument via a friction fit.

7. The cap of claim 1, wherein the writing instrument has an integral pocket clip, and wherein said elongated barrel is adapted to engage an end of the writing instrument including the integral pocket clip, the engagement being via a friction fit.

8. A combination for use in operating a touch screen having microswitches, the combination comprising:

a cap, and an elongated writing instrument;

wherein said cap comprises:

an elongated barrel having an open first end thereof, and an operating tip connected to a second end of said elongated barrel; and wherein said writing instrument is engaged with the cap by being partially inserted into said open first end of said elongated barrel, and wherein said operating tip is dimensioned so as to be sufficiently small to reliably actuate the microswitches via contact with the touch screen and so as to be sufficiently large to reliably prevent such contact from damaging the touch screen.

9. The combination of claim 8, wherein said operating tip has a frustoconical shape, said operating tip having a narrowest extremity that has a width in the range of about 0.1 mm to about 1 mm.

10. The combination of claim 9, wherein said narrowest extremity of said operating tip has a width of about 1.0 mm.

11. The combination of claim 8, further comprising: a pocket clip attached to said elongated barrel at a peripheral portion of said first end.

12. The combination of claim 8, wherein said elongated barrel is substantially cylindrical and is sized to engage said writing instrument via a friction fit.

13. The combination of claim 8, wherein said writing instrument has an integral pocket clip, and wherein said elongated barrel is adapted to engage an end of said writing instrument including said integral pocket clip, the engagement being via a friction fit.

14. A pen cap having an open end and a closed end, further comprising an operating tip, wherein the operating tip is cone-shaped, with a narrow ending tip having a width of about 2 mm, and wherein the operating tip extends about 5 mm from the closed end of the pen cap; and wherein the operating tip is dimensioned so as to be sufficiently small to reliably actuate the microswitches via contact with the touch screen and so as to be sufficiently large to reliably prevent such contact from damaging the touch screen.

* * * * *